US007443274B2

(12) United States Patent
Lee et al.

(10) Patent No.: US 7,443,274 B2
(45) Date of Patent: Oct. 28, 2008

(54) INDUCTOR AND FABRICATING METHOD THEREOF

(75) Inventors: Cheng-Hong Lee, Taoyuan Hsien (TW); Yi-Hong Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/508,294

(22) Filed: Aug. 23, 2006

(65) Prior Publication Data

US 2007/0115087 A1 May 24, 2007

(30) Foreign Application Priority Data

Nov. 23, 2005 (TW) ..... 94141111 A

(51) Int. Cl.
*H01F 27/36* (2006.01)

(52) U.S. Cl. ..... 336/84 M

(58) Field of Classification Search ..... 336/65, 336/83, 200, 212, 213, 225, 229, 84 R, 84 M
See application file for complete search history.

(56) References Cited

U.S. PATENT DOCUMENTS

| | | | | |
|---|---|---|---|---|
| 3,781,740 | A * | 12/1973 | Kirmis et al. | 336/96 |
| 5,731,666 | A * | 3/1998 | Folker et al. | 315/276 |
| 6,642,672 | B2 * | 11/2003 | Hu et al. | 315/276 |
| 2006/0125586 | A1 * | 6/2006 | Lee et al. | 336/83 |

* cited by examiner

*Primary Examiner*—Tuyen T. Nguyen
(74) *Attorney, Agent, or Firm*—Birch, Stewart, Kolasch & Birch, LLP

(57) ABSTRACT

An inductor includes a closed core, a magnetic medium and a coil. The magnetic medium covers at least a portion of the closed core. The coil winds around the closed core or the magnetic medium. A fabricating method of the inductor is also disclosed.

24 Claims, 6 Drawing Sheets

INDUCTOR AND FABRICATING METHOD THEREOF

BACKGROUND OF THE INVENTION

1. Field of Invention

The present invention relates to an inductor and a fabricating method thereof, and more particularly to an inductor and a fabricating method thereof capable of eliminating noises.

2. Related Art

Complex electrical circuits have been widely applied to electronic devices such as a power supply and an electric energy converter in the recent years. However, such circuits are operated under high-frequency switching, so the electromagnetic interference (EMI) will easily be induced and affect the operation of the electronic devices. The EMI is divided into two categories by transmitting way: one is radiated interference and the other is conducted interference. The radiated interference is transmitted without any medium, and the conducted interference is transmitted via a wire.

Conducted interference is further divided into common mode noise and differential mode noise in accordance with the transmitting path of the noise current. Differential mode noise is induced when the current of two wires are in reverse directions. Common mode noise is induced when the currents of all wires are in the same directions.

As shown in FIG. 1, a conventional inductor 1 capable of eliminating common mode noise and differential mode noise includes a circular first core 10, a second core 11 which is disposed inside the first core 10, a couple of coils 12*a* and 12*b* which are wound around the first and second cores 10 and 11, and a spacers 13 which is disposed between the first core 10 and the second core 11. The second core 11 has an annular frame 111 and a bridge 112 which is laid in the frame 111.

The first core 10 is made of a material which is easy to become magnetic saturation but has a large magnetic permeability for eliminating common mode noise, and the second core 11 is made of a material which is hard to become magnetic saturation but has a low magnetic permeability for eliminating differential mode noise.

As shown in FIG. 1, when common mode noise currents $I_1$ and $I_2$ flow in the coils 12*a* and 12*b*, respectively, as indicated by the arrows, magnetic fluxes $\phi_1$ and $\phi_2$ come together and decline gradually while circulating in a closed magnetic circuit of the first core 10. This is because the magnetic fluxes $\phi_1$ and $\phi_2$ are converted into heat energy as an eddy current loss or the like. Thus, common mode noise can be eliminated. In addition, as shown in FIG. 2, when a differential mode noise current $I_3$ flows in the coils 12*a* and 12*b* as indicated by the arrows, magnetic fluxes $\phi_3$ and $\phi_4$ occur in the second core 11. The magnetic flux $\phi_3$ circulates in a closed magnetic circuit formed of the left half of the frame 111 and the bridge 112, and the magnetic flux $\phi_4$ circulates in a closed magnetic circuit formed of the right half of the frame 111 and the bridge 112. The magnetic fluxes $\phi_3$ and $\phi_4$ are converted into heat energy as eddy current losses or the like and decline gradually while circulating in the respective closed magnetic circuits. Thus, differential mode noise can be eliminated.

However, the construction of the conventional inductor 1 wastes manpower and time of the fabrication, and is unfavorable to the diminishing of scale. It is thus imperative to provide an inductor and a fabricating method thereof capable of facilitating the fabrication and the minimization, and effectively eliminating common mode noises and differential mode noises.

SUMMARY OF THE INVENTION

In view of the foregoing, the present invention provides an inductor and a fabricating method thereof capable of facilitating the fabrication and the minimization, and effectively eliminating common mode noises and differential mode noises.

To achieve the above, an inductor according to the present invention includes a closed core, a magnetic medium and a coil. The magnetic medium covers at least a portion of the closed core. The coil winds around the closed core or the magnetic medium.

To achieve the above, another inductor according to the present invention includes a magnetic body and a couple of coils. The magnetic body includes a closed core and a magnetic medium. The magnetic medium covers at least a portion of the closed core. The couple of coils are wound around the magnetic body.

To achieve the above, a fabricating method of an inductor according to the present invention includes the steps of providing a closed core; covering at least a portion of the closed core by a magnetic medium; and winding a coil around the closed core or the magnetic medium.

To achieve the above, another fabricating method of an inductor according to the present invention includes the steps of providing a closed core; covering at least a portion of the closed core by a magnetic medium to form a magnetic body; and winding a couple of coils around the magnetic body.

As mentioned above, the inductor according to the present invention utilizes a magnetic medium covering a closed core which is wound by a couple of coils, or utilizes a magnetic medium covering a closed core and then wound by a couple of coils. The magnetic medium can be a magnetic tape, or is made of magnetic plastics such that common mode noises and differential mode noises can be eliminated by the inductor. Compared with the prior art, the magnetic medium of the present invention is formed on the closed core by injection molding, grouting or winding, so the inductor of the present invention can simplify the fabricating steps, facilitate the fabrication and the minimization, and effectively eliminate common mode noises and differential mode noises. Thus, the cost is reduced and the production yield is raised.

BRIEF DESCRIPTION OF THE DRAWINGS

The present invention will become more fully understood from the detailed description given herein below illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
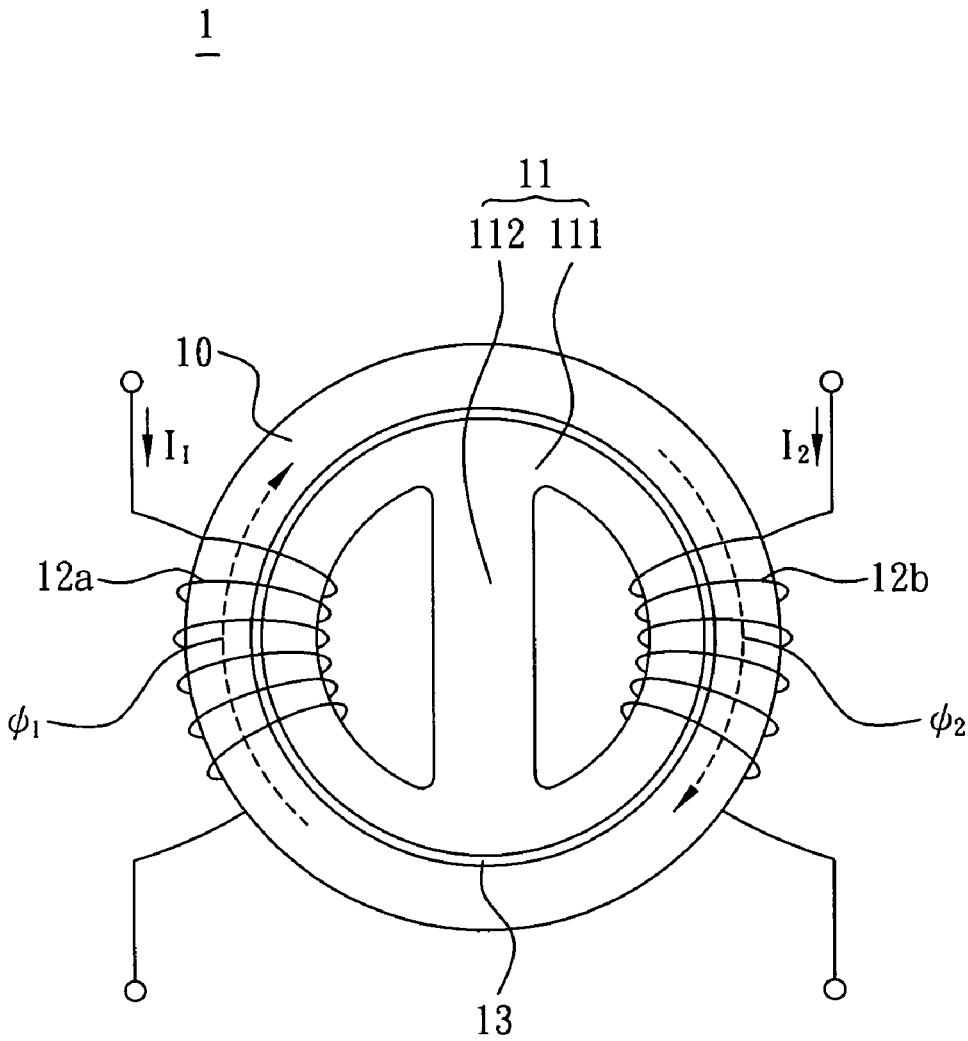
FIG. 1 (PRIOR ART)
FIG. 1 is a magnetic circuit diagram of a conventional inductor showing the function of eliminating common mode noises.
Figure 2:
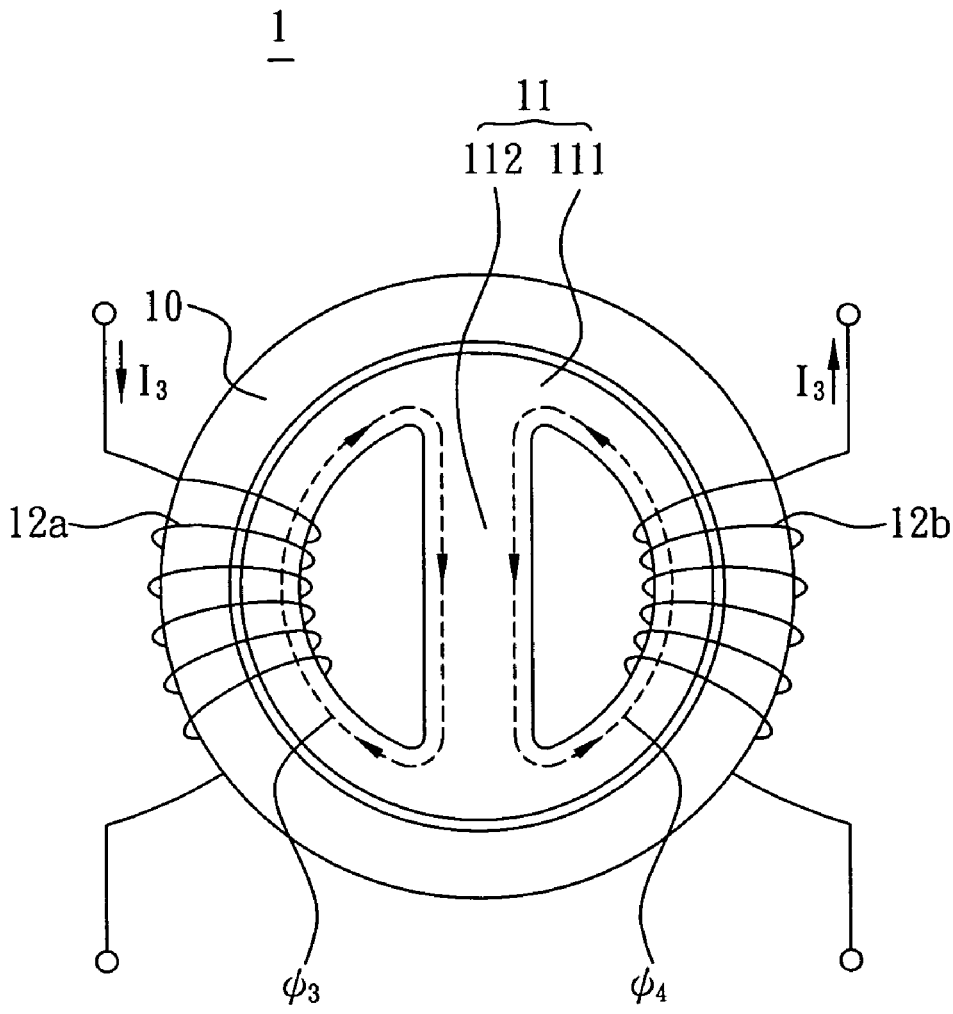
FIG. 2 (PRIOR ART)
FIG. 2 is a magnetic circuit diagram of the conventional inductor of FIG. 1 showing the function of eliminating differential mode noises.
Figure 3:
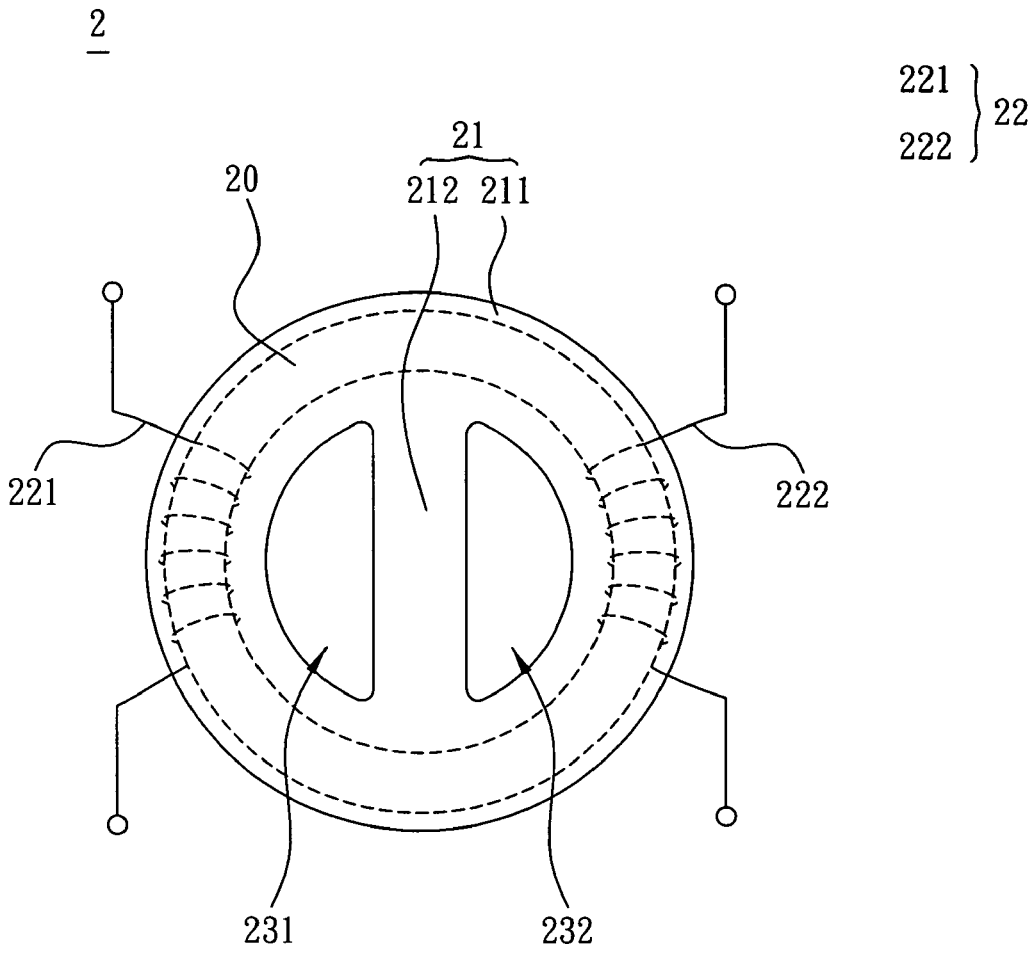
FIG. 3 is a schematic view of an inductor according to a preferred embodiment of the present invention.

As shown in FIG. 3, an inductor 2 according to a preferred embodiment of the present invention includes a closed core 20, a magnetic medium 21 and a couple of coils 22. The couple of coils 22 are wound around the closed core 20. In this embodiment, a coil 221 of the couple of coils 22 is wound around the left half of the closed core 20, and the other coil 222 of the couple of coils 22 is wound around the right half of the closed core 20.

The closed core 20 enables the common mode noise currents flowing in the coils 221 and 222, respectively, to generate a closed magnetic circuit such that common mode noises can be eliminated. The closed core 20 is in an annular shape in this embodiment, but the other alternative shapes, such as hollow square shape or hollow irregular shape, constructing a closed circuit are all allowed. The material of the closed core 20 is magnetic ferrite or an amorphous material, and the magnetic ferrite is ferric oxide, nickel oxide, copper oxide, zinc oxide, manganese oxide, cobalt oxide or a mixture thereof.

The magnetic medium 21 covers at least a portion of the closed core 20 and the couple of coils 22. The magnetic medium 21 is made of a mixture of magnetic material and resin, and the magnetic material is iron, silicon, cobalt, nickel, aluminum, molybdenum, their oxide or a mixture thereof. The resin is a thermosetting resin or a photo curable resin. In this embodiment, the magnetic medium 21 covers the closed core 20 and the couple of coils 22 by injection molding or grouting. The magnetic medium 21 includes an annular frame 211 and a bridge 212 partitioning the frame 211 into two portions 231 and 232 which are respectively wound by the coils 221 and 222. The inductor 2 enables the differential mode noise current flowing in the coils 221 and 222 to generate two closed magnetic circuits such that differential mode noises can be eliminated.

Figure 4:
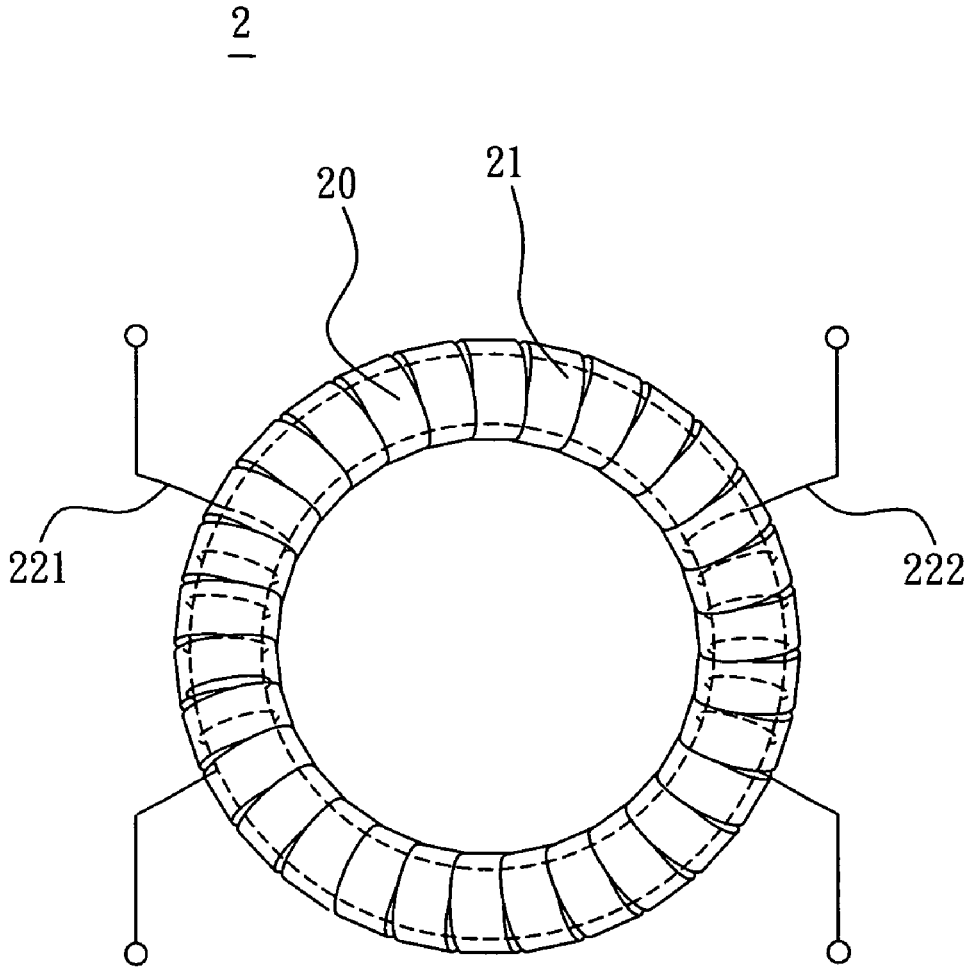
FIG. 4 is a schematic view of a magnetic tape used as a magnetic medium of the inductor of FIG. 3.

As shown in FIG. 4, the magnetic medium 21 also can be a magnetic tape winding the closed core 20, and may include a frame and a bridge (not shown in FIG. 4).

Figure 5:
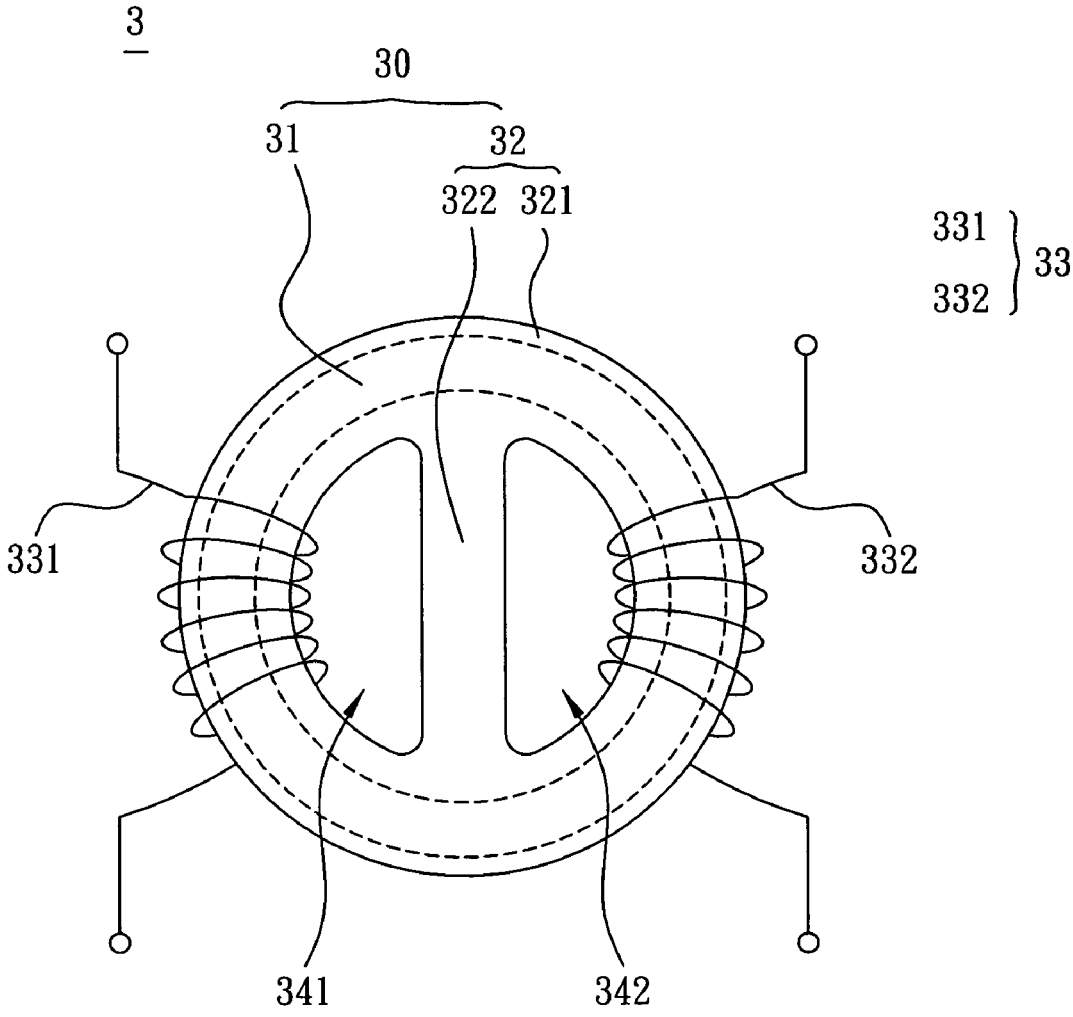
FIG. 5 is a schematic view of another inductor according to a preferred embodiment of the present invention.

With reference to FIG. 5, another inductor 3 according to a preferred embodiment of the present invention includes a magnetic body 30 and a couple of coils 33. The magnetic body 30 includes a closed core 31 and a magnetic medium 32. The magnetic medium 32 covers at least a portion of the closed core 31. As described above, the magnetic medium 32 is made of a mixture of magnetic material and resin, and includes a frame 321 and a bridge 322 formed by injection molding or grouting. In other words, the magnetic medium 32 and the closed core 31 are formed integrally as a single piece. The frame 321 is partitioned into two portions 341 and 342 by the bridge 322. In addition, the magnetic medium 32 can be a magnetic tape winding the closed core 31.

The constructions, functions, materials and characteristics of the closed core 31 and the magnetic medium 32 are the same as those described in the previous embodiment; the detailed descriptions thereof will be omitted.

The couple of coils 33 are wound around the magnetic body 30. In this embodiment, a coil 331 of the couple of coils 33 passes through the portion 341 and is wound around the left half of the magnetic body 30, and the other coil 332 of the couple of coils 33 passes through the portion 342 and is wound around the right half of the magnetic body 30.

The closed core 31 provides the effect of eliminating common mode noises, and the structure composed of the magnetic medium 32 provides the effect of eliminating differential mode noises.

Figure 6:
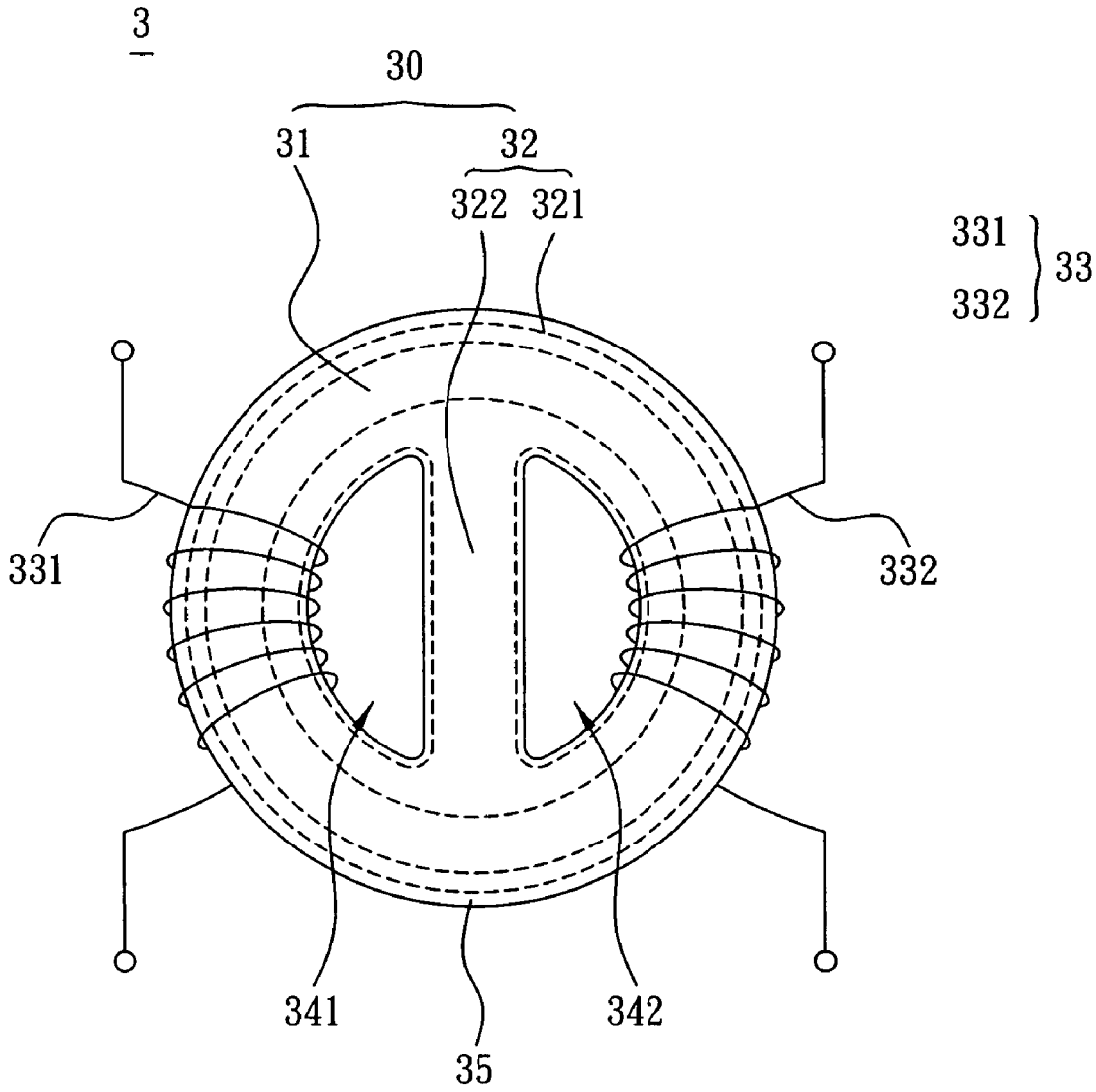
FIG. 6 is the inductor of FIG. 5 further including a casing accommodating a closed core and a magnetic medium therein.

As shown in FIG. 6, the magnetic body 30 of the inductor 3 further includes a casing 35 accommodating the closed core 31 and the magnetic medium 32 therein. The couple of coils 33 are wound around the casing 35. The material of the casing 35 is an insulating material, such as plastics.

In summary, an inductor and a fabricating method thereof according to the present invention utilizes a magnetic medium covering a closed core which is wound by a couple of coils, or utilizes a magnetic medium covering a closed core and then wound by a couple of coils. The magnetic medium can be a magnetic tape, or is made of magnetic plastics such that common mode noises and differential mode noises can be eliminated by the inductor. The magnetic medium is formed on the closed core by injection molding, grouting or winding. Compared with the prior art, the inductor according to the present invention can simplify the fabricating steps, facilitate the fabrication and the minimization, and effectively eliminate common mode noises and differential mode noises. Thus, the effects of lowering the fabrication cost and raising the production yield are achieved.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. An inductor comprising:

a closed core;

a magnetic medium including an annular frame and a bridge partitioning the frame into two portions, wherein the magnetic medium completely covers the closed core; and a coil wound around the closed core or the magnetic medium.

2. The inductor according to claim 1, wherein the magnetic medium is a magnetic tape, or is made of magnetic plastics which is a mixture of magnetic material and resin.

3. The inductor according to claim 2, wherein the magnetic material is iron, silicon, cobalt, nickel, aluminum, molybdenum, their oxide, or a mixture thereof.

4. The inductor according to claim 2, wherein the resin is a thermosetting resin or a photo curable resin.

5. The inductor according to claim 1, wherein two portions are respectively wound by the coil.

6. The inductor according to claim 1, wherein the closed core is made of magnetic ferrite or an amorphous material.

7. The inductor according to claim 6, wherein the magnetic ferrite is ferric oxide, nickel oxide, copper oxide, zinc oxide, manganese oxide, cobalt oxide or a mixture thereof.

8. The inductor according to claim 1, wherein the closed core is in an annular shape, a hollow square shape, or a hollow irregular shape.

9. The inductor according to claim 1, further comprising an insulating casing accommodating the closed core and the magnetic medium.

10. A fabricating method of an inductor, comprising the steps of:

providing a closed core;

completely covering the closed core by a magnetic medium, wherein the magnetic medium includes a frame and a bridge partitioning the frame into two portions; and winding a coil around the closed core or the magnetic medium.

11. The fabricating method according to claim 10, wherein the magnetic medium is made of a mixture of magnetic material and resin.

12. The fabricating method according to claim 11, wherein the magnetic material is iron, silicon, cobalt, nickel, aluminum, molybdenum, their oxide, or a mixture thereof.

13. The fabricating method according to claim 11, wherein the resin is a thermosetting resin or a photo curable resin.

14. The fabricating method according to claim 10, wherein the closed core is made of magnetic ferrite or an amorphous material.

15. The fabricating method according to claim 14, wherein the magnetic ferrite is ferric oxide, nickel oxide, copper oxide, zinc oxide, manganese oxide, cobalt oxide or a mixture thereof.

16. The fabricating method according to claim 10, wherein the closed core is in an annular shape, a hollow square shape, or a hollow irregular shape.

17. The fabricating method according to claim 10, wherein the magnetic medium covers the closed core and the coil by injection molding or grouting.

18. The fabricating method according to claim 10, wherein the magnetic medium is a magnetic tape winding the closed core and the coil.

19. The fabricating method according to claim 10, wherein the portions are respectively wound by the coil.

20. The fabricating method according to claim 10, further comprising a step of: covering the magnetic medium by a casing before winding the coil.

21. The inductor according to claim 1, wherein the magnetic medium covers the closed core and the coil by injection molding or grouting.

22. The fabricating method according to claim 10, wherein the magnetic medium covers the closed core and the coil by injection molding or grouting.

23. The inductor according to claim 1, wherein the magnetic medium and the closed core are formed integrally as a single piece.

24. The fabricating method according to claim 10, wherein the magnetic medium and the closed core are formed integrally as a single piece.

* * * * *